US007807000B1

(12) United States Patent
Baker

(10) Patent No.: US 7,807,000 B1
(45) Date of Patent: Oct. 5, 2010

(54) THERMOBARIC EXPLOSIVES, ARTICLES OF MANUFACTURE, AND METHODS COMPRISING THE SAME

(75) Inventor: James J. Baker, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 392 days.

(21) Appl. No.: 10/975,122

(22) Filed: Oct. 25, 2004

(51) Int. Cl.

| | |
|---|---|
| ***C06B 47/00*** | (2006.01) |
| ***C06B 45/18*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/109.4; 149/1; 149/3; 149/87; 149/108.2; 149/109.2; 149/109.6

(58) Field of Classification Search ..... 149/87, 149/1, 3, 108.2, 109.2, 109.4, 109.6
See application file for complete search history.

(56) References Cited

U.S. PATENT DOCUMENTS 3,381,473 A * 5/1968 Kuehl ..... 60/219
6,955,732 B1 * 10/2005 Chan et al. ..... 149/92

* cited by examiner

*Primary Examiner*—Jerry Lorengo
*Assistant Examiner*—James E McDonough
(74) *Attorney, Agent, or Firm*—Fredric J. Zimmerman

(57) ABSTRACT

A thermobaric explosive composition is provided that includes coated fuel particle, a nitramine, and binder. The coated fuel particles preferably have a magnesium core and an aluminum coating. Upon detonation, the nitramine disperses the coated fuel particles over a blast area during a first overpressure stage. The aluminum coating of the fuel particles has a thickness selected to provide an amount of aluminum that is stoichiometrically less than an amount of ambient-air oxygen available in the blast area for aerobic combustion with the aluminum during the first overpressure stage. Once exposed, the magnesium cores may combust to increase the impulse generated in the first overpressure stage. Also provided are articles of manufacture and related methods.

11 Claims, 2 Drawing Sheets

THERMOBARIC EXPLOSIVES, ARTICLES OF MANUFACTURE, AND METHODS COMPRISING THE SAME

STATEMENT REGARDING FEDERALLY SPONSORED RESEARCH OR DEVELOPMENT

The invention described herein may be manufactured and used by or for the Government of the United States of America for governmental purposes without the payment of any royalties thereon or therefore.

BACKGROUND OF THE INVENTION

1. Field of the Invention

This invention relates to the field of explosive compositions, especially compositions useful for thermobaric weapons, and further relates to thermobaric weapons and methods for making and deploying the same.

2. Description of the Related Art

Thermobaric explosives (TBX) are a class of volumetric weaponry designed to produce heat and pressure effects. Thermobaric explosives are generally fuel-rich (e.g., aluminum rich) compositions usually containing a nitramine or other oxidizer or energetic, and are characterized by an energy release occurring over a longer period of time than standard explosives.

FIG. 3 is a graph comparing the pressure pulse of a thermobaric explosive (TBE) to that of a high explosive (HE). In the graph, a high explosive (HE) and thermobaric explosive (TBE) are detonated at time to, creating respective pressure pulses. The peak overpressure ($P_{HE}$) of the initial pressure pulse of the high explosive is much greater than the corresponding peak overpressure ($P_{TBE}$) of the initial pressure pulse of the thermobaric explosive. However, the initial pressure pulse generated by a high explosive is typically much shorter in duration than the corresponding pressure pulse of a thermobaric explosive (TBE). The overpressure generated by the high explosive drops at a much faster rate, passing below ambient pressure at time $t_{HE}$. In contrast, although the thermobaric explosive has a lower initial peak overpressure $P_{TBE}$ in FIG. 3, the initial pressure pulse of the thermobaric explosive continues in duration until $t_{TBE}$. As a consequence of the extended duration of the thermobaric explosive initial pressure pulse, the total impulse generated by the thermobaric explosive (represented graphically by the area between the TBE curve and ambient pressure between times $t_0$-$t_{TBE}$) is greater than the total impulse of the high explosive.

Without necessarily wishing to be bound by a particular theory, it is believed that the thermobaric explosive undergoes the following stages upon detonation. In a first overpressure stage, an initial shock (or blast) wave upon detonation of the explosive causes the nitramine to undergo anaerobic detonation in an essentially reduction-oxidization (redox) reaction occurring within hundreds of microseconds to disperse an expanding cloud of the flammable aluminum fuel particles into the surrounding air. This blast wave consumes most of the nitramine. Any remaining nitramine will contribute to an anaerobic combustion or dispersion of the fuel particles. The amount of fuel burned in this anaerobic reaction may be considered negligible. The cloud of fuel-rich energetic material is subject to aerobic combustion, which results from dispersed aluminum fuel particles in the shock wave mixing with oxygen in the surrounding air to produce a mammoth fireball that may last up to several seconds. The total impulse released in this first overpressure stage may be sufficient to flatten a building or penetrate deeply into complex and entrenched structures, such as caves and multi-room buildings.

After the first overpressure stage has ended, i.e., at time $t_{TBE}$ until a vacuum is left behind in the area in which the thermobaric explosive has been detonated. This vacuum draws in close objects, including unexploded fuel particles that create almost complete penetration into all non-airtight objects within the blast radius, which are then incinerated. A second overpressure stage begins at time $t_5$. However, the impulse created in this second overpressure stage is negligible compared to the first overpressure stage for the purposes of this description, and is not discussed further herein.

It is desirable to increase the total impulse generated by a thermobaric weapon during the initial pressure pulse. An increased impulse would improve the destructive force of the explosive, for example, in the leveling of a reinforced building or the penetration of particularly deep or windy caves or multi-room structures. Theoretically, raising the peak overpressure ($P_{TBE}$) or prolonging the duration ($t_{TBE}$) of the initial pressure pulse should increase the impulse of the thermobaric weapon.

It has been found that raising the concentration of aluminum fuel particles beyond about 35 weight percent of the total weight of the thermobaric explosive does not significantly increase the initial impulse of the explosion. Aluminum fuel particles require oxygen for combustion. The oxygen available for aerobic combustion of the aluminum fuel particles is limited to the oxygen present in ambient air in close proximity to the detonation site, and more specifically to the oxygen in ambient air that comes into contact with the dispersed aluminum. The aluminum particles deplete the available ambient-air oxygen. As a consequence, it has been considered wasteful to exceed a 35 weight percent loading of fuel particles in a thermobaric composition, because insufficient ambient-air oxygen is available to combust excess aluminum particles in the first overpressure reaction.

Non-combusted aluminum fuel particles do not contribute significantly to the initial pressure pulse and can account for size and weight penalties. More typically, the fuel particle load is closer to about 20 weight percent.

3. Objects of the Invention

It is an object of this invention to provide a thermobaric composition that undergoes a relatively long initial pressure pulse to increase the overall impulse generated by the composition during the initial pressure pulse.

It is another object of this invention to provide articles of manufacture, such as but not necessarily limited to warheads, bombs, projectiles, grenades and munitions comprising the thermobaric explosive of this invention.

It is yet another object of this invention to provide methods for making and deploying the thermobaric explosives and articles of manufacture of the present invention.

SUMMARY OF THE INVENTION

In accordance with the purposes of the invention as embodied and broadly described in this document, a first aspect of this invention provides a thermobaric explosive composition that achieves one or more of the foregoing objects. The composition of this aspect of the invention comprises coated fuel particles, a nitramine, and a binder. During a first overpressure stage following detonation of the thermobaric explosive, the nitramine disperses the coated fuel particles over a blast area in which the fuel particles combust. The coated fuel particles comprise metallic cores and an aluminum coating, the metallic cores comprising a metal other than aluminum, the metal having a higher reactivity with carbon dioxide and water than aluminum. The aluminum coating preferably has a thickness selected to provide an amount of aluminum that is stoichiometrically less than or equal to an amount of ambient-air oxygen available in the blast area for aerobic combustion with the aluminum during the first overpressure stage.

Without necessarily wishing to be bound by any theory, because the aluminum is present in an amount stoichiometrically less than or equal to the surrounding ambient-air oxygen available for combustion, sufficient aluminum should combust to expose the underlying metallic core. The core is then allowed to react with any residual oxygen in the air, and with oxygen-containing by-products of the aerobic combustion reaction, such as carbon dioxide, carbon monoxide, and water. The reaction of the metallic cores extends the duration of the reaction, essentially moving time $t_{TBE}$ to the right in FIG. 3. The longer duration of the initial pressure pulse correspondingly increases the impulse of the initial pressure pulse.

According to a second aspect of the invention, an article of manufacture comprising the thermobaric explosive of the first aspect of the invention. Representative articles include rocket-propelled grenades and bombs. The thermobaric explosive of the articles comprises coated fuel particles, a nitramine, and a binder. During a first overpressure stage following detonation of the thermobaric explosive, the nitramine disperses the coated fuel particles over a blast area in which the fuel particles combust.

The coated fuel particles comprise metallic cores and an aluminum coating. The metallic cores comprise a metal other than aluminum, the metal having a higher reactivity with carbon dioxide and water than aluminum. The aluminum coating preferably has a thickness selected to provide an amount of aluminum that is stoichiometrically less than or equal to an amount of ambient-air oxygen available in the blast area for aerobic combustion with the aluminum during the first overpressure stage.

According to a third aspect of the invention, a method is provided for making the thermobaric explosive composition of the first aspect of the invention. The method preferably yet optionally comprises pressing or casting the thermobaric explosive into the casing of an article of manufacture.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
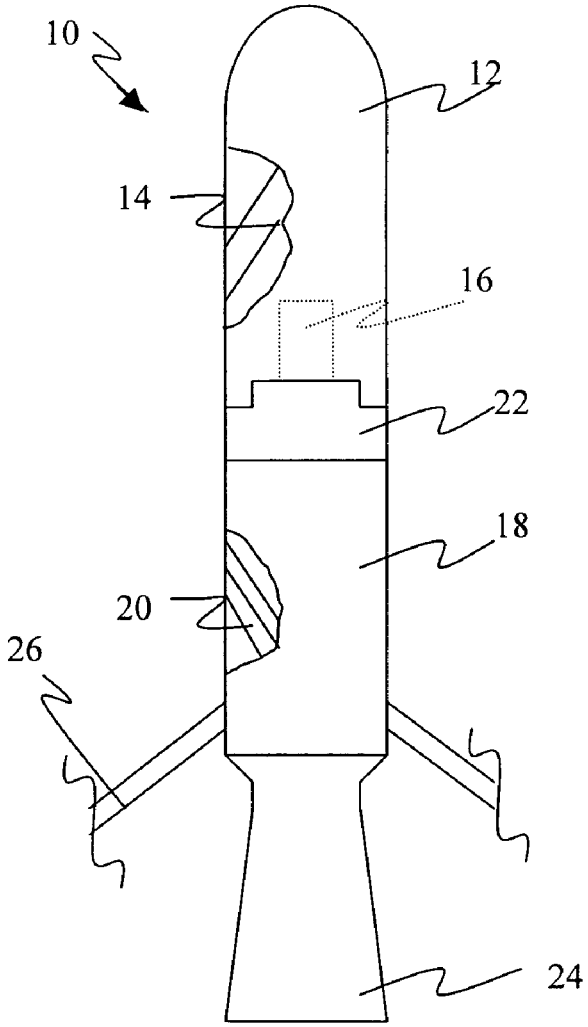
FIG. 1 is a schematic, partially cut-away side view of a rocket-propelled warhead according to an embodiment of the invention.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

According to a preferred embodiment of the invention, the thermobaric explosive composition comprises coated fuel particles, a nitramine, and a binder. Upon detonation of the thermobaric explosive, the nitramine disperses the coated fuel particles over a blast area in which the fuel particles combust during a first overpressure stage.

The coated fuel particles preferably yet optionally possess one or more of the following properties: a high heat of combustion, relatively low melting point, high surface area (small particle size), and flammability. The fuel particles may have an average particle diameter, for example, in a range from about 0.1 micron to about 50 microns, more preferably about 1 micron to about 5 microns. Generally, particles sizes below this range, such as "nanoparticles," have high weight ratios of oxide surface layers. Larger particle sizes have lower surface area ratios and may compromise performance. In an optional embodiment, the fuel particles may consist of or consist essentially of particles having dimensions in these ranges. The fuel particles preferably comprise from about 20 weight percent to about 45 weight percent of the total weight of the thermobaric explosive composition.

The coated fuel particles comprise an innermost metallic core and an aluminum coating. The innermost metallic core comprises a metal other than aluminum, the metal having a greater reactivity with water and carbon dioxide than aluminum, i.e., is more easily oxidized than aluminum. The innermost metallic core preferably comprises and optionally consists of or consists essentially of magnesium, although other metals and alloys may be used alone or in combination with magnesium. Fine metallic particles of magnesium and other metals and alloys are commercially available. The magnesium core is coated with an aluminum coating, which preferably possesses a thin outer layer of aluminum oxide. The aluminum oxide layer protects the aluminum and core metal from reacting with other ingredients within the explosive composition until the explosive is initiated. The metallic cores (exclusive of the coating or oxide layer) of the fuel particles preferably constitute from about 50 volume percent to about 95 volume percent, optionally about 70 to about 90 volume percent, of the total volume of the coated fuel particles. The aluminum coating and the aluminum oxide layer preferably comprise the remainder of the volume. The aluminum oxide layer is preferably sufficient in thickness to provide a protective layer for avoiding premature reaction of the aluminum of the aluminum coating, but preferably is thin enough to comprise less than 1 volume percent of the particle.

The fuel particle coating preferably surrounds the metallic cores and preferably is substantially uniform in thickness around the metallic cores. The coating may be applied using conventional aluminum deposition techniques, such as chemical or vapor deposition. The coating thickness is selected to provide an amount of aluminum that will react sufficient with the ambient-air oxygen to expose the underlying metallic cores during the first pressure pulse stage. Preferably, the coating thickness is stoichiometrically less than or equal to the amount of ambient-air oxygen available in the blast area for aerobic combustion with the aluminum during the first overpressure stage. The aluminum of the aluminum coating preferably constitutes from about 5 volume percent to about 50 volume percent, more preferably about 10 volume percent to about 30 volume percent, of the total volume of the coated fuel particles. Thickness of the aluminum coating is dependent upon the diameter of the fuel particle, and the size of the device into which the explosive is played, but is ascertainable once the fuel particle diameters and coating and core densities have been selected. According to one preferred but not necessarily limiting embodiment, the aluminum coating (including the aluminum oxide protective layer) thickness is about 10% to about 33% of the overall thickness of the fuel particles.

The oxidizer of the thermobaric composition comprises, and optionally consists of or consists essentially of, one or more nitramines. The selected nitramine preferably has one or more of the following properties: a high heat of combustion, a high detonation pressure, and a high detonation velocity. Representative nitramines useful in the thermobaric explosive composition of embodiments of the invention include, for example, 1,3,5-trinitro-1,3,5-triazacyclohexane (RDX), 1,3,5,7-tetranitro-1,3,5,7,-tetraazacyclooctane (HMX), and 2,4,6,8,10,12-hexanitro-2,4,6,8,10,12-hexaazatetracyclo-[5.5.0.0$^{5,9}$0$^{3,11}$]-dodecane (CL-20 or HNIW). Of these, RDX and HMX are especially preferred for use alone or in combination.

The nitramine is preferably present in particulate form. The nitramine particles are preferably spherical, but may take other forms, such as granules, prills, flakes, etc. The nitramine particles may be present in a mono-modal or multi-modal distribution. Mono-modal distributions may have an average particle size of, for example, about 5 microns for fine particles or about 200 microns for coarse particles. An exemplary bi-modal distribution consists of about 90 weight percent coarse particles having an average particle size of about 200 microns, and about 10 weight percent fine particles having an average particle size of about 5 microns.

A portion, but preferably no more than about 50 weight percent, and optionally no more than 30 weight percent, of the nitramine is replaceable with an ionic salt oxidizer. Examples of such oxidizers include nitrates and perchlorates, including ammonium nitrate, ammonium perchlorate, potassium nitrate, potassium perchlorate, sodium nitrate, and sodium perchlorate. Another oxidizer that may replace a portion or all of the nitramine is a fluorocarbon, such as polytetrafluoroethylene. According to a preferred embodiment, the coated fuel particles, the nitramine, the optional ionic salt oxidizer, and the binder constitute from about 92 weight percent to about 99 weight percent or more of the thermobaric explosive composition.

Representative binders that may be used with various embodiments include, for example, thermoplastic and thermoplastic elastomer polymers, such as polyolefins (e.g., polybutadiene), polyacrylates (e.g., HyTemp®), fluoroelastomers (e.g., Viton®), thermoplastic polyesters (e.g., Estane®), polyoxiranes (e.g., GAP), polyoxetanes, poly-α-olefins, and waxes, especially petroleum-based waxes (e.g., paraffin waxes, microcrystalline waxes).

The thermobaric explosive composition may optionally include additional components. For example, plasticizers, such as dioctyl adipate (DOA), may be selected. Other optional ingredients include antioxidants (e.g., AO2246, 2,2'-Methylenebis (4-methyl-6-tertiarybutyl phenol)) cure catalysts (e.g., triphenyl bismuth (TPB)), curing agents (e.g., isophorone diisocyanate (IPDI)), and bonding agents (e.g., DHE, di-(2-hydroxyethyl)-5,5-dimethylhydantoin). It should be understood that other ingredients and specific compounds may be selected.

An example of a thermobaric explosive composition of the present invention is set forth in the table below.

| Component | Parts By Weight |
|---|---|
| R45HT (HTPB polymer) | 7.342 |
| DOA (plasticizer) | 7.456 |
| AO2246 (antioxidant) | 0.100 |
| TPB (cure catalyst) | 0.015 |
| DHE (bonding agent) | 0.260 |
| Fuel particles | 40.000 |
| RDX | 63.889 |
| IPDI | 0.938 |

A method for making a thermobaric explosive composition according to an embodiment of the invention will be described below. The described method is exemplary; however, the thermobaric explosive compositions of this invention are not necessarily limited to explosives made by this exemplary method.

According to an embodiment of the invention, the explosive composition is prepared as follows. The coated fuel particles may be prepared using chemical or vapor deposition, preferably in an inert atmosphere. The aluminum oxide protective layer may be formed during the metallic core coating process by slowing bleeding oxygen into the process. The fuel particles and binder are mixed together into a homogeneous mixture, followed by the addition of the nitramine and any other energetics and oxidizers. Mixing is preferably continued until homogeneity is reached, at which time the curative is added and mixing is continued. Mixing may be performed, for example, in a vertical mixer such as a Baker-Perkins mixer, although other mixing and blending devices may be selected. Mixing operations are preferably conducted below about 160° F. (71° C.), more preferably at about 100° F. (38° C.). Mixing operations are preferably performed in a vacuum. A binder solvent may optionally be included to improve processability. After casting, curing is conducted preferably below about 150° F. (65.6° C.), more preferably at about 140° F. (60° C.), overnight if not longer, although cure temperatures and times will depend upon the particular curative and amount of cure accelerator used.

Figure 2:
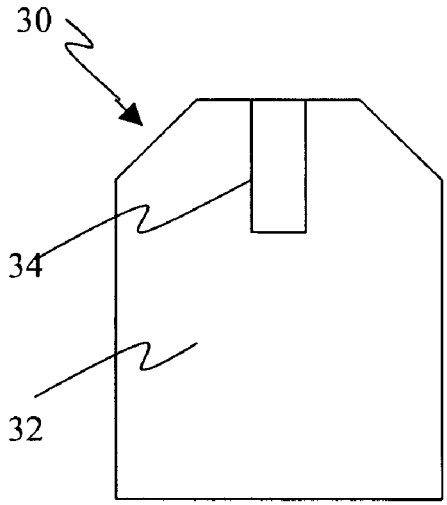
FIG. 2 is a sectional side view of a bomb according to another embodiment of the invention.
Figure 3:
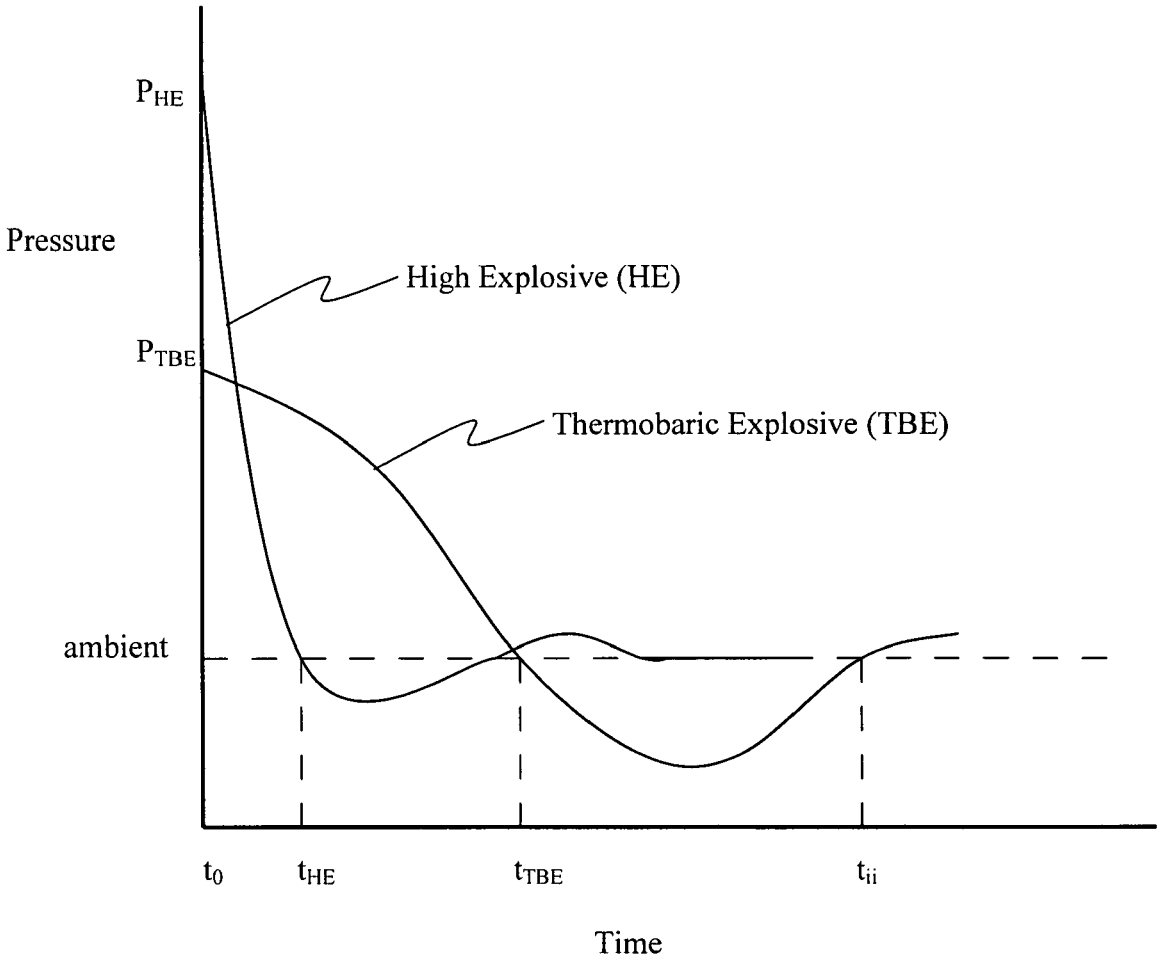
FIG. 3 is a graph comparing the total impulses of a thermobaric explosive and a high explosive, respectively.

The thermobaric explosives of the present invention may serve as a component of an article of manufacture, such as a weapon or projectile. For example, FIG. 1 illustrates a projectile, such as a shoulder-launched projectile, generally designated by reference numeral 10. The projectile 10 comprises a warhead casing 12 loaded with a thermobaric explosive 14, a fuse 16, a motor case 18 loaded with a propellant charge 20, an end closure 22 for attaching the motor case 18 to the warhead case 12, and an aft nozzle assembly 24 (the left side shown in section) comprising an igniter and a plurality of fins 26. The propellant charge 20 is ignitable to produce hot gases which pass through the nozzle assembly 24 to generate thrust and propel the warhead to its intended target, where the explosive 14 is detonated. Embodiments of the thermobaric composition of the present invention may be cast as explosive 14 into warhead casing 12. Casting and pressing techniques are well known in the art. According to another embodiment of the invention, the thermobaric explosive may form the explosive charge of a bomb 30, such as shown in FIG. 2. The bomb 30 comprises a fuse or detonator 34 and explosive charge 32 comprising the thermobaric composition disclosed herein.

The thermobaric explosives of embodiments of the present invention may have one or more of the following advantages compared to conventional plastic bonded explosives: a higher density, permitting a higher explosive weight to be delivered to the target; a higher heat of combustion, permitting the delivery of more heat to a target; a higher flame temperature, permitting the generation of higher temperatures at the target; and a longer reaction duration.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A thermobaric explosive composition, consisting of:

coated fuel particles comprising metallic cores and an aluminum coating, wherein the metallic cores comprise a metal other than aluminum, the metal has a higher reactivity with carbon dioxide and water than aluminum, and wherein the aluminum coating includes a thickness selected to provide an amount of aluminum that undergoes sufficient aerobic combustion to expose the metallic cores in a first overpressure stage following detonation of the thermobaric explosive composition;

a nitramine for dispersing the coated fuel particles over a blast area where the fuel particles aerobically combust during the first overpressure stage; and a binder, wherein the aluminum coating comprises aluminum and an aluminum oxide outer protective layer on the aluminum, and wherein the aluminum is a non-alloy aluminum material where the aluminum coating surrounds the metallic cores, and wherein said aluminum oxide outer protective layer comprises less than one (1) volume percent of each particle of said coated fuel particles, and wherein the coated fuel particles include an average particle diameter of about 0.1 micron to about 50 microns.

2. The thermobaric explosive composition according to claim 1, wherein the aluminum coating includes a thickness in a range of about 10 percent to about 33 percent of an overall thickness of the coated fuel particles.

3. The thermobaric explosive composition according to claim 1, wherein the thermobaric explosive composition is castable.

4. The thermobaric explosive composition according to claim 1, wherein the coated fuel particles constitute about 20 to about 45 weight percent of the total weight of the thermobaric explosive composition.

5. The thermobaric explosive composition according to claim 1, wherein the metal comprises magnesium.

6. The thermobaric explosive composition according to claim 1, wherein the metallic cores constitute about 50 to about 95 volume percent of the total volume of the coated fuel particles, and wherein the aluminum of the aluminum coating constitutes about 5 volume percent to about 50 percent of the total volume of the coated fuel particles.

7. The thermobaric explosive composition according to claim 1, wherein the metallic cores constitute about 70 to about 90 volume percent of the total volume of the coated fuel particles, and wherein the aluminum of the aluminum coating constitutes about 10 volume percent to about 30 volume percent of the total volume of the coated fuel particles.

8. The thermobaric explosive composition according to claim 1, wherein the coated fuel particles constitute about 20 to about 45 weight percent of the total weight of the thermobaric explosive composition, wherein the metal comprises magnesium; and wherein the metallic cores constitute about 70 to about 90 volume percent of the total volume of the coated fuel particles, and wherein the aluminum of the aluminum coating constitutes about 10 volume percent to about 30 volume percent of the total volume of the coated fuel particles.

9. The thermobaric explosive composition according the claim 1, wherein the nitramine comprises a member selected from HMX and RDX.

10. The thermobaric explosive composition according to claim 1, wherein the coated fuel particles, the nitramine, the binder, and any additional oxidizers collectively constitute from about 92 weight percent to about 99 weight percent of the thermobaric explosive composition.

11. The composition according to claim 1, wherein the aluminum coating is substantially uniform in thickness around the metallic cores.

* * * * *